US005461840A

United States Patent [19]

Taylor

[11] Patent Number: 5,461,840

[45] **Date of Patent: * Oct. 31, 1995**

[54] CARDBOARD SPACER/SEAL AS THERMAL INSULATOR

[76] Inventor: Donald M. Taylor, 3844 Sundown Drive, Nanaimo, British Columbia, Canada, V9T 4H5

[ * ] Notice: The portion of the term of this patent subsequent to Mar. 1, 2011, has been disclaimed.

[21] Appl. No.: 197,915

[22] Filed: Feb. 17, 1994

Related U.S. Application Data

[63] Continuation-in-part of Ser. No. 135,709, Oct. 13, 1993, Pat. No. 5,394,671.

[51] Int. Cl.[6] ..... E04C 2/54

[52] U.S. Cl. ..... 52/786.13

[58] Field of Search ..... 52/790, 788, 789, 52/172, 171; 428/34, 38

[56] References Cited

U.S. PATENT DOCUMENTS

| | | | |
|---|---|---|---|
| 4,015,394 | 4/1977 | Kessler | 52/616 |
| 4,057,945 | 11/1977 | Kessler | 52/398 |
| 4,109,431 | 8/1978 | Mazzoni | 52/172 |
| 4,171,601 | 10/1979 | Gotz | 52/790 |
| 4,198,254 | 4/1980 | Laroche | 156/107 |
| 4,222,213 | 9/1980 | Kessler | 52/790 |
| 4,226,063 | 10/1980 | Chenel | 52/172 |
| 4,613,530 | 9/1986 | Hood et al. | 428/34 |
| 4,640,078 | 2/1987 | Haffer | 52/731 |
| 4,719,728 | 1/1988 | Erikson | 52/172 |
| 5,290,611 | 3/1994 | Taylor | 428/34 |

*Primary Examiner*—Carl D. Friedman
*Assistant Examiner*—Creighton Smith
*Attorney, Agent, or Firm*—Caesar, Rivise, Bernstein et al.

[57] ABSTRACT

A multi-paned insulated light, such as a window, incorporates an interior panel spacer/seal that includes a thermal insulating layer of cardboard. The cardboard serves as a low cost insulating layer and may be used in conjunction with rolled or extruded metal spacer forms, so as to vastly diminish the thermal bridging effect normally present with such metallic sections. The cardboard spacer can be used adjoining either the "cold" pane or the "hot" pane of the multi-paned unit, or may be interposed between adjacent metallic sections, as a thermal break therebetween. The cardboard is preferably sealed with a surface sealing layer such as polyvinyl alcohol, to effectively preclude gas percolation therepast. Alternatively, an effective gas seal such as polyvinyl alcohol may be incorporated into the cardboard at its time of manufacture.

22 Claims, 3 Drawing Sheets

FIG.6.
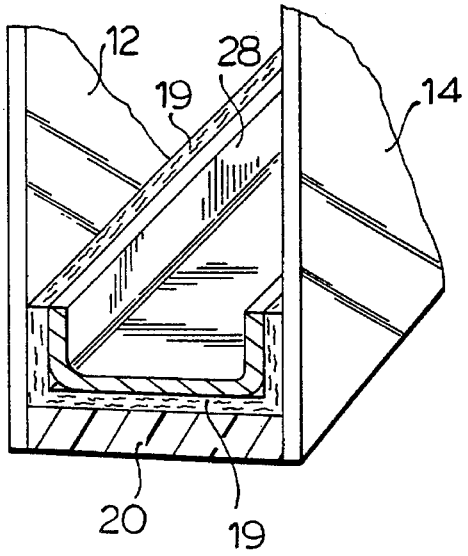
FIG.7.
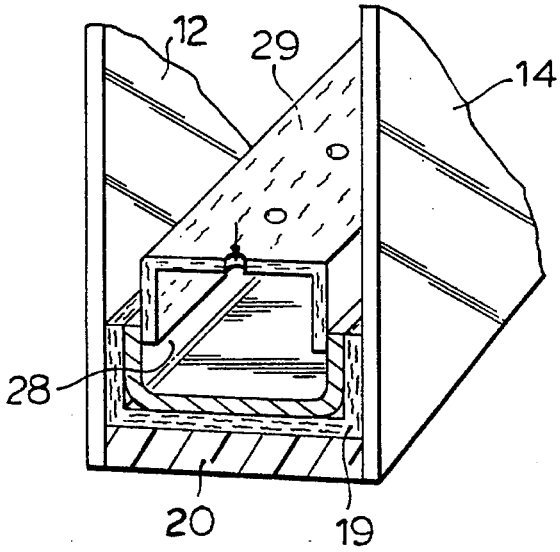
FIG.8.
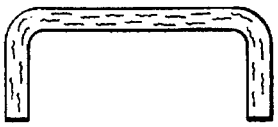
FIG.9.
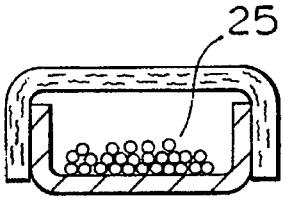
FIG.10.
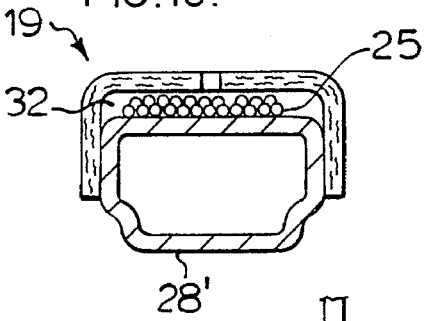
FIG.11.
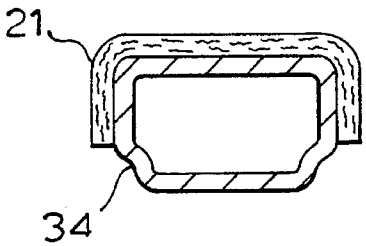
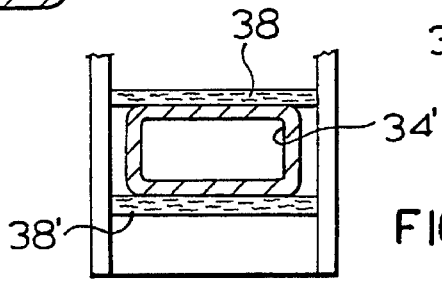
FIG.12.

CARDBOARD SPACER/SEAL AS THERMAL INSULATOR

This application is a Continuation-in-Part of application Ser. No. 08/135,709 filed Oct. 13, 1993 now U.S. Pat. No. 5,394,671.

TECHNICAL FIELD

This invention is directed to multi-paned lights, such as windows, and in particular to an insulative spacer/seal between adjacent lights incorporating a cardboard insulative layer.

BACKGROUND ART

In the glazing industry the use of multi-paned window lights for use in windows, doors, patio doors and the like has gown tremendously, due to the greater insulative protection that these provide.

However, the problem of thermal bridging is associated with metallic spacer/seal sections.

Efforts to overcome or substantially diminish the thermal bridging effect have included such things as the provision of two metal sections with a thermal break barrier therebetween, such as a urethane layer between the metal sections. While reasonably thermally efficient, such systems are unduly costly, costing in the price range of $1.64 per linear meter of seal length (i.e. $0.50 per linear foot).

Other attempted solutions to the problem have included extruded plastic spacer/seals, and other applied and over-extruded thermoplastic thermal insulators. However, in addition to expense, such spacer/seals are subject to outgassing, which over time can contaminate the enclosed sealed space between the panes, with consequent loss of insulative efficiency and optical clarity.

One solution to the spacer/seal problems, as set forth in my copending U.S. patent application Ser. Nos. 07/609,336, 07/925,537 and 08/081,530, respectively filed Nov. 5, 1990, Aug. 5, 1992 and Jun. 23, 1993 is the use of a hollow cardboard section, wherein utilization is made of the high linear insulative value of cardboard.

DISCLOSURE OF THE INVENTION

However, I now find that the insulative value of cardboard, with its microsporous cellular structure, is of such high order that it is possible to use an ostensibly solid piece of cardboard as an effective insulating layer in conjunction with metal spacer sections, such as existing metal seals.

Such a cardboard-composite spacer/seal construction can equal or even exceed the thermal performance of the aforementioned expensive composite spacer/seal incorporating a urethane thermal barrier, and at significantly lower cost, and with increased convenience and facility of use.

The possibility of outgassing and/or gas or water vapour migration through the cardboard may be effectively precluded by use of polyvinyl alcohol and/or SARAN (TM) as a protective coating or sheath to the cardboard.

The incorporation of such a sealing component into the initial making of the cardboard also is contemplated, in carrying out the present invention.

Certain of the advantages in the use of cardboard as an applied or an interposed sealing layer, in conjunction with metallic spacer/seals is the ease with which the cardboard can be incorporated as an edge layer or as an interposed thermal barrier layer. Thus, a spacer/seal "frame" or "frames" can be made up of a metal section, sized to the periphery of the light being manufactured, and the cardboard, as an outer layer or as an intermediate barrier can then be bonded to an edge or edges of the spacer frame, so as to complete the spacer/seal, for installation between the panes of the light.

In accordance with general practice, it is contemplated that the physical strength of the spacer/seal will be complemented with an outer peripheral seal of polysulphide sealant, as the cardboard component of the spacer seal develops its greatest structural strength in compression, and may be liable to delaminate if subject to tension. The use of a polysulphide outer seal, in accordance with general practice, substantially precludes any undue tensile forces acting upon the spacer seal.

In discussing the thickness of paper or cardboard it will be noted that each "point" is one mil i.e. 0.001 inches.

It has been found that adequate thermal insulation may be provided with cardboard as thin as 14½ mil (0.0145 inches) size. Increased rail thickness promotes greater insulative capacity. Even paper-thin board affords a useful improvement in insulative quality.

An important characteristic of cardboard is its almost zero thermal expansion/contraction coefficient, yet I have found that it still retains both resiliency and ductility sufficient to respond to the different coefficients of expansion/contraction of the glass pane and of a metal spacer with which the cardboard may be used.

The present invention thus provides a spacer/seal for use with multi-paned lights in interposed spacing and sealing relation therewith, having a thermal barrier of cardboard in interposed relation with a structural spacer, such as a metallic spacer.

In view of the excellent insulative quality of the cardboard spacer it is contemplated that the construction of the metallic spacing element may be greatly simplified, as its thermal conductivity characteristics are no longer critical, so that the use of very thin metal sections or of special metals is no longer paramount, and lower cost metals and fabrication techniques, and more robust metal sections may be adopted, in combination with the cardboard thermal barrier layer.

However, the present invention enables the continued use of metal spacer sections presently in use, complemented by the simple addition of a cardboard layer or layers, integrated as an edge seal or seals, or as an interposed thermal brake between a pair of metallic spacer sections, and sealed when and where necessary against percolation therethrough of gas and/or water vapour.

I have found that the insulative value of cardboard exceeds that of the rubbers which have been used, heretofore as adhesive and insulating edging.

Thus there is provided a spacer seal for use with a multi-paned light, the spacer seal having a structural frame, and an interposed thermal barrier of cardboard to limit thermal conduction between adjacent panes through the structural frame.

The cardboard may be sealed with a sealant such as polyvinyl alcohol.

The sealant may be provided as a surface coating to the cardboard.

A further moisture-proof sealing layer such as SARAN (TM) may be used to further protect the integrity of the seal.

The aforesaid structural frame may include a hollow metal section having at least one surface to receive a layer of cardboard in adjoining, thermally insulating relation therewith, interposed in the thermal conductivity path between the adjacent panes.

In the case of metal sections having profiled edge surfaces, the cardboard layer may be conformed with the profile of the section.

In addition, in the case of extruded plastic spacers wherein exist the problems of outgassing from the spacer into the enclosed window section between the glasses, a cardboard spacer or spacers can serve to seal off the plastic spacer from the hollow window section, while complementing both the insulative and the structural characteristics of the window spacer/seal.

A further embodiment may comprise an inverted U-section of cardboard, comprising a pair of opposing legs and intermediate bight portions that may be used in combination with an existing spacer, such as a low cost extruded aluminum U-section or a stainless steel or other more exotic and more expensive spacer, or with an over-extruded thermoplastic spacer-seal.

By straddling the legs of the cardboard section outside an existing spacer/seal base section, the cardboard sewer as a thermal break to isolate the base section from the glass, while the bight portion of the cardboard section may serve as a cover to the hollow base section, so as to provide an enclosed desiccant container. This then enables the use of low cost loose desiccant, to be filled on site if so desired, as distinct from laid-in strip coating desiccant in present use.

The cardboard may be made substantially gas and vapour impermeable, preferably at least on the leg portions of the section. The bight-portion of the cardboard section may be perforated, to enable the desiccant to perform its role of moisture absorption. By leaving the bight portion of the cardboard section untreated i.e. gas and vapour permeable, perforation may be avoided.

If used with a laterally non-rigid section, the cardboard provides additional functions, serving to damp-out vibrations imparted on the face of one glass pane, so as to diminish noise transfer, while favourably modifying the flexing characteristics of the metal spacer.

The cardboard spacer is particularly well adapted to receive a variety of low cost surface finishes, enabling the decor customizing of window units.

In the case of the inverted U-section, it could be the outer surface of the bight portion that could be decorated. Any other viewable surface may also be decorated.

A flashed-on metalized layer, such as aluminum may be provided for purposes of decoration, and also to supplement or even replace the sealing layers, as taught above.

The invention thus provides a multi-paned light combined with a spacer/seal between a pair of adjacent panes, the spacer/seal being in the form of a frame, including at least one cardboard layer in thermally interposed relation with a thermal conductivity path extending between the panes, by way of the frame of the spacer/seal.

The aforesaid combination includes an outer, peripheral seal of polysulphide sealant.

The aforesaid cardboard layer includes a plastic sealant to substantially preclude passage of fluids into and through the cardboard.

The present invention further provides a cardboard insulating spacer for use in combination with a spacer in a multi-paned glazing unit, the combination comprising a base spacer section selected from the group consisting of metal and plastic spacers, and a cardboard section secured thereto in complementary insulation relation therewith, to enhance the thermal insulative characteristics of the base spacer, and wherein at least one of the aforementioned sections is a sealing section, to substantially seal the interior space enclosed by the panes of the glazing unit and the spacer combination.

One embodiment of cardboard insulating spacer may be of U-section of a size to contact two opposed sides of the base section.

The cardboard U-section, when inverted, may fit between upstanding leg portions of a base section.

The inverted cardboard U-section may have the leg portions thereof overlying sidewall portions of the base section, in insulating relation therewith.

A further embodiment may comprise a metal or other non-insulative section having a cardboard spacer/insulator seal attached to at least one face of the metal or other section, with the cardboard serving to support the section away from the glazing panes.

The cardboard spacer leg portions may form an enclosure in combination with the base section.

All, or selected portions of the cardboard spacer may be substantially gas and vapour proof. A bight portion of a cardboard spacer of U-section may be perforated, for use in combination with a desiccant substance.

The cardboard of the spacer, or selected portions thereof, may serve as a desiccant. The desiccant nature thereof may be supplemented by the incorporation of a suitable desiccant material into, or as a layer of the cardboard.

The provisions of a layered cardboard is contemplated incorporating a sealing layer of substantially gas and vapour proof character, and a desiccant layer wherein at least one face of the layer is porous to water vapour.

The cardboard strip for carrying out the invention may incorporate a layer or layers of pressure sensitive adhesive with a protective release cover, for application to existing spacer/seal sections.

BRIEF DESCRIPTION OF THE DRAWINGS

FIGS. 6 and 7 are similar to FIG. 4, and show two modes of use of a U-section cardboard;

FIG. 8 is an end section view of an inverted U-section cardboard spacer/seal;

FIG. 9 is an end section of a FIG. 8 embodiment combined with an existing spacer/seal of U-section, to form a potential desiccant compartment;

FIG. 10 is a view similar to FIG. 9 showing a further combination spacer/seal incorporating a cardboard spacer/seal, and including a desiccant compartment provisions;

FIG. 11 shows a further combination spacer/seal embodiment; and

FIG. 12 is an end view of a further embodiment.

BEST MODE OF CARRYING OUT THE INVENTION

Figure 1:
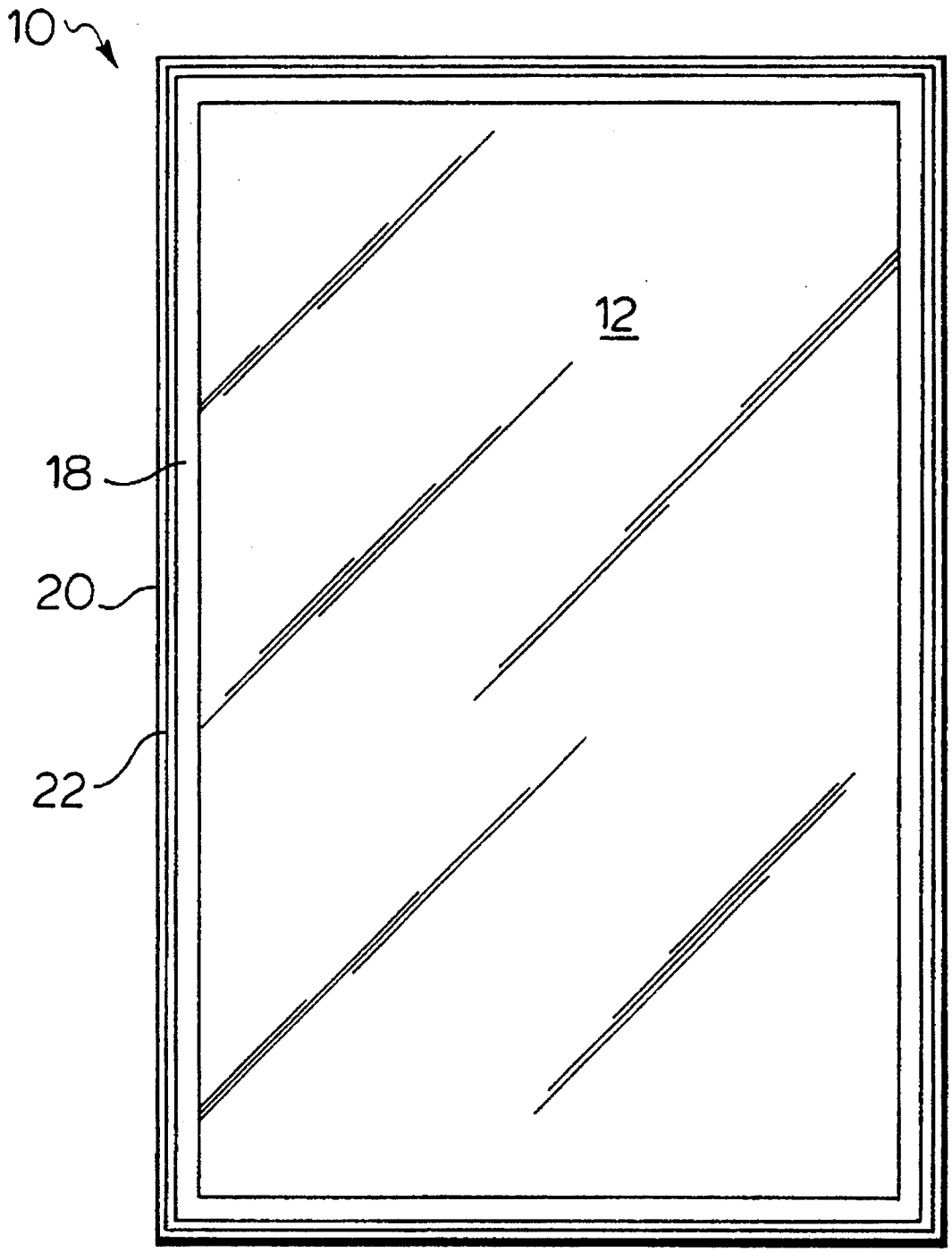
FIG. 1 is a schematic side view of a light incorporating a spacer/seal peripheral frame in accordance with the present invention.

Referring to FIG. 1, a frameless multi-paned glazing unit 10 has a spaced-apart pair of glass panels, the rear panel 12 being seen. The outer periphery comprises an enclosing polysulphide seal 20, within which a portion of metallic spacer 22 is shown.

A cardboard insulating spacer/seal 18 is interposed between the inner face of the glass 12 and the metal spacer 22. The metal spacer 22 is made up as a peripheral frame, installed within the outer periphery of the panel or pane 12, being hermetically enclosed by the polysulphide seal 20.

The edge of metal spacer 22, adjacent the pane 12, is separated therefrom by the overlying cardboard layer of insulator/seal 18.

Figure 2:
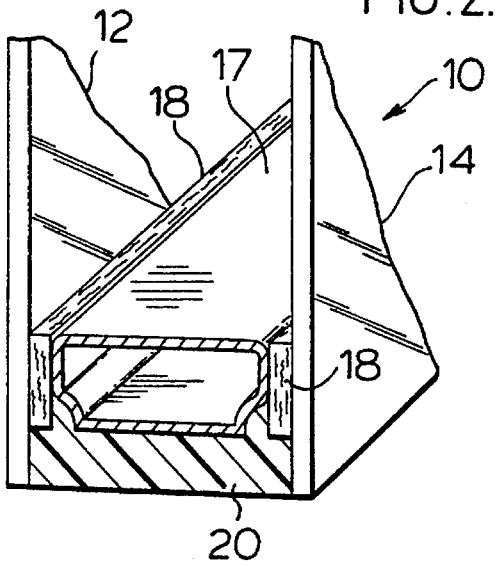
FIG. 2 is a section in end perspective showing one embodiment of the present invention.
Figure 3:
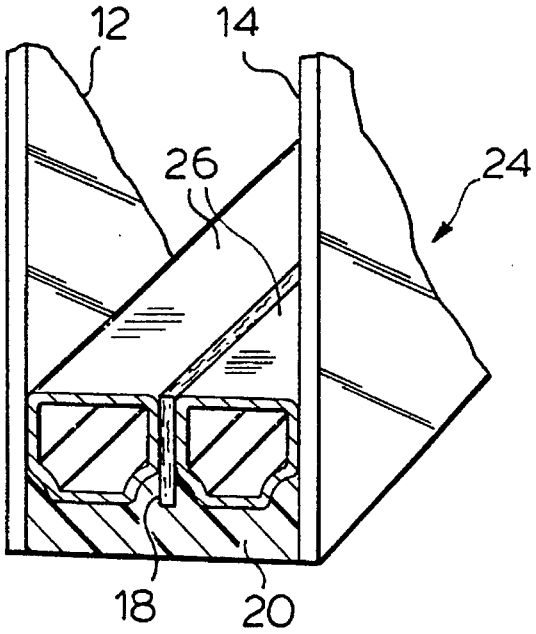
FIG. 3 is a view similar to FIG. 2, showing a second embodiment of the invention.
Figure 4:
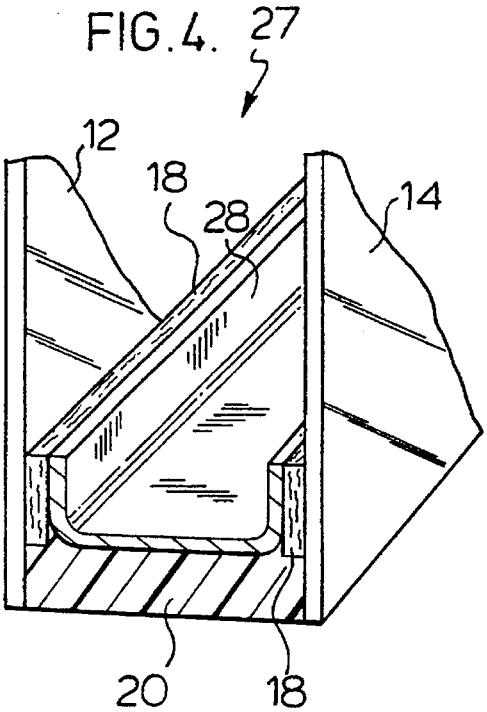
FIGS. 4 and 5 are views similar to FIGS. 2 and 3 showing a third and a fourth embodiment of the invention.
Figure 5:
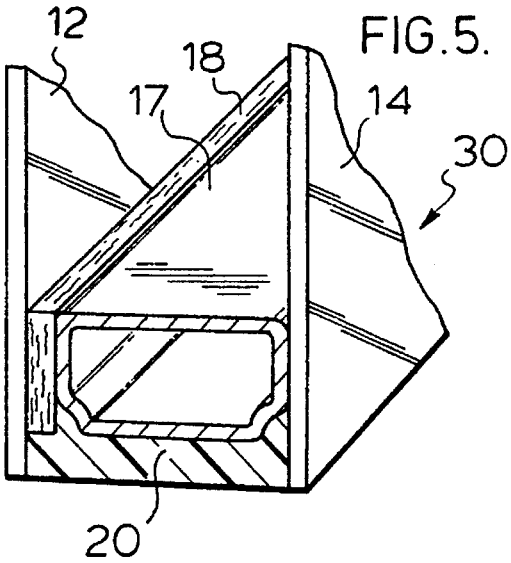

Referring to FIG. 2, in the seal assembly 10, the pane 12 may be considered as the "cold" face of the unit 10, the other pane, 14 being considered as the "warm" face, as is the case also in FIGS. 3, 4 and 5.

A metallic spacer 17 has both sides-thereof bounded by cardboard insulator/seals 18, sealingly bonded to the spacer 17 and to the adjoining inner surfaces of panes 12 and 14 respectively.

Referring to FIG. 3, the seal arrangement 24 comprises a pair of like metal sections 26, each sealingly bonded by its outer edge to the adjoining inner face of panes 12 and 14 respectively.

A cardboard insulator spacer/seal 18 is interposed between and sealingly bonded to the adjoining inner edge faces of the metal sections 26, so as to form a thermal break therebetween.

Referring to FIG. 4, the arrangement 27 shows a metal spacer 28 of U-section having both outer edges thereof thermally isolated from the adjacent glass faces of panes 12, 14, by way of cardboard insulator spacer/seals 18. Both faces of the insulator spacer/seals 18 are sealingly bonded to the respective adjoining surfaces.

In the FIG. 5 arrangement 30, the single cardboard insulator spacer/seal 18 is shown installed at the "cold" edge of a metallic spacer 17.

In each of the above cases a polysulphide peripheral seal 20 is shown.

Referring to FIG. 6, a U-section metal spacer 28 is thermally isolated from the inner surfaces of the glass panes 12, 14 by way of the leg portions 19' of a cardboard insulator spacer 19. A polysulphide seal 20 completes the installation. The cardboard insulator spacer 19 may be initially bonded to the spacer/seal section 28, prior to the making thereof into a "frame" as shown in FIG. 1. Alternatively, the cardboard spacer 19 may be affixed at the site. In this instance the paramount function of the insulator spacer 19 is its thermal insulative characteristics.

It is contemplated that the leg portions 19', if untreated with sealant, may serve as a built-in desiccant. The bottom or bight portion of the cardboard section 19 would most likely require to be gas and vapour-proofed, as taught above.

Referring to the FIG. 7 embodiment, the cardboard spacer/seal section 29 may be used with a metal or a plastic U-section spacer/seal, the cardboard section 29 being bonded to the wall inside surfaces, to form an enclosure, illustrated as being perforated.

In the case of a metal spacer seal 29, which can form, if imperforate, an effective seal, the inverted cardboard section need not be made gas and water vapour impervious. It may be perforated, as illustrated, to facilitate the functioning of any desiccant contained therein.

FIG. 8 shows the inverted U-section of a cardboard spacer as embodied in FIGS. 7 and 9–11. The horizontal bight portion may be gas and vapour proofed, and may be perforated, for use with desiccant.

In the FIG. 10 embodiment a plastic spacer 28' is insulated by the side legs of the perforated cardboard section 19, while providing a readily accessible compartment 32 to curtain the desiccant 25.

In FIG. 11, a metal spacer 34 has an imperforate cardboard cover 21 according to the invention, the cover 21 being impervious to gas and/or water vapour, as described above.

In FIG. 12, a metal spacer 34' has a cardboard spacer/insulating layer 38 and a second outer insulating and sealing spacer layer 38' securing the spacer 34' in isolated relation from the adjacent glazing panes.

In addition to the thermal insulation provided by the subject cardboard spacer/seal, the mechanical characteristics of the section and its physical qualities complement those of the "original" spacer/seal section. These complementary qualities include added strength and enhanced stiffness, vibration damping, sound absorbtion, elective use as a desiccant as an alternative or partial alternative to use as an impervious seal.

In most, if not all the foregoing embodiments a polysulphide outer peripheral seal or its equivalent is part of the combination, to complement the low tensile strength characteristics of the cardboard seal/spacer.

It will be understood that the location of the thermally insulating cardboard spacer/seal may be adjoining either or both the "cold" and the "warm" pane of the glazing unit.

It will be evident, in view of the present practice of fabricating metallic spacer/seal sections into a peripheral frame formulation, that introduction of a planar cardboard spacer/seal 18, by bonding one or more thereof to one or more edges of the fabricated metal frame is extremely simple.

The installation of the modified spacer/seal between the panes of the unit is virtually unchanged. The same may be said for the application of the outer polysulphide peripheral seal which encloses the outer edge of the glazing unit.

As previously indicated, the form of the cardboard seal of U-section facilitates the installation of desiccant in-factory or at the site.

INDUSTRIAL APPLICABILITY

This invention is of major commercial importance in that it is readily applicable to most, if not all presently existing insulation systems, in order to significantly enhance their insulative quality, and improve their mechanical characteristics and sound damping.

What is claimed is:

1. A cardboard insulating ribbon of restricted width, having a plastic sealing component to preclude percolation of fluids therethrough, for use in combination with spacer seals in multi-paned glazing units, to provide an insulative thermal break between the inner faces of adjacent panes of a said unit.

2. The insulating ribbon as set forth in claim 1, having a thickness of 10 mil or greater.

3. The insulating ribbon as set forth in claim 1, wherein said plastic sealing component comprises polyvinyl alcohol.

4. The insulating ribbon as set forth in claim 2, wherein said plastic sealing component comprises polyvinyl alcohol.

5. The insulating sealing ribbon as set forth in claim 3, wherein said polyvinyl alcohol comprises a surface layer.

6. The cardboard insulating ribbon as set forth in claim 1, in combination with a spacer/seal for use in a multi-paned glazing unit, said ribbon being sealingly bonded to at least one side of said spacer/seal, to provide an insulative thermal break thereto.

7. The combination as set forth in claim 6, said spacer seal comprising a metallic section.

8. The combination as set forth in claim 7, comprising a pair of said metallic sections, having said cardboard ribbon sealingly bonded therebetween to provide a transverse thermal break between the outer edges of said sections.

9. The combination as set forth in claim 6, having two of said ribbons bonded in sealing relation to opposed outer edges of said spacer/seal, said spacer/seal being made up into a frame.

10. The combination as set forth in claim 6, combined with a pair of glazing panes, having said insulated spacer/seal bonded in sealed, spacing relation between said panes.

11. The combination as set forth in claim 7, combined with a pair of glazing panes, having said insulated spacer/seal bonded in sealed, spacing relation between said panes.

12. The combination as set forth in claim 8, combined with a pair of glazing panes, having said insulated spacer/seal bonded in sealed, spacing relation between said panes.

13. The combination as set forth in claim 10, including a second, outer peripheral seal in sealed, enclosing relation with said spacer/seal.

14. The combination as set forth in claim 11, including a second, outer peripheral seal in sealed, enclosing relation with said spacer/seal.

15. The combination as set forth in claim 12, including a second, outer peripheral seal in sealed, enclosing relation with said spacer/seal.

16. A cardboard insulating seal for use in combination with a spacer in a multi-paned glazing unit, said combination comprising an extruded base spacer section selected from the group consisting of metal and plastic spacers, and a cardboard section secured thereto in complementary insulating relation therewith, to enhance the thermal insulative characteristics of said base spacer, and wherein at least one said spacer is a sealing section.

17. The combination as set forth in claim 16, said cardboard section being of U-section of a size to contact two opposed sides of said base section.

18. The combination as set forth in claim 16, said cardboard section being of U-section of a size to fit in sealing relation within upstanding leg portions of said base section.

19. The combination as set forth in claim 17, said cardboard U-section having opposed side walls overlying sidewalls of said base section; said cardboard U-section being inverted, and having perforations through a base portion thereof lying between said side walls.

20. The combination as set forth in claim 19, said cardboard U-section having a gas/vapour seal for at least one selected surface portion thereof.

21. A cardboard insulating seal in combination with a substantially rigid spacer section, in a glazing light; said cardboard insulating seal having at least one cardboard section secured in adherent sealing, spacing relation between a pair of glazing lights, and having said rigid spacer section supported by said cardboard seal in thermally isolated relation from said glazing lights.

22. The combination as set forth in claim 21, said rigid spacer section having one said cardboard section adheringly secured to an inner face of the spacer section, and a second said cardboard section adheringly secured to an outer face of the spacer section.

* * * * *